United States Patent [19]

Lindner

[11] Patent Number: 4,885,812

[45] Date of Patent: Dec. 12, 1989

[54] COMBINATION BACKPACK AND COT

[75] Inventor: Charles E. Lindner, Scarborough, Canada

[73] Assignee: Ron Carriere, Gormley, Canada; a part interest

[21] Appl. No.: 229,470

[22] Filed: Aug. 5, 1988

[30] Foreign Application Priority Data

Jul. 8, 1988 [CA] Canada ..... 57508

[51] Int. Cl.[4] ..... A47C 29/00

[52] U.S. Cl. ..... 5/113; 5/112; 135/95; 135/903; 224/154; 224/156

[58] Field of Search ..... 5/113, 112; 135/95, 135/903; 224/154, 155, 156

[56] References Cited

U.S. PATENT DOCUMENTS

| | | | |
|---|---|---|---|
| 2,639,442 | 5/1953 | Herzog | 5/112 |
| 3,158,299 | 11/1964 | Weir et al. | 5/113 X |
| 3,601,825 | 8/1971 | Moorhead | 5/113 |
| 3,619,827 | 11/1971 | MacKenzie | 5/113 |
| 3,620,428 | 11/1971 | Silverthorne | 224/156 |
| 3,757,360 | 9/1973 | Wescott | 5/113 |
| 3,828,992 | 8/1974 | Cerchione | 5/112 X |
| 3,848,279 | 11/1974 | Ipsen, Jr. | 5/113 |
| 3,912,138 | 10/1975 | Pava | 224/156 X |
| 3,918,109 | 11/1975 | Barraclough | 224/154 X |
| 3,931,918 | 1/1976 | Smith et al. | 224/154 |
| 3,933,164 | 1/1976 | Ness et al. | 224/156 X |
| 3,971,495 | 7/1976 | Velazquez | 5/113 |
| 4,077,418 | 3/1978 | Cohen | 135/95 |
| 4,234,005 | 11/1980 | Taylor, III | 5/113 X |
| 4,286,739 | 9/1981 | Silcott et al. | 224/156 |
| 4,491,258 | 1/1985 | Jones | 224/210 X |

FOREIGN PATENT DOCUMENTS

| | | | |
|---|---|---|---|
| 502511 | 5/1954 | Canada | 5/113 |
| 1229140 | 9/1960 | France | 5/112 |
| 73733 | 7/1948 | Norway | 224/156 |
| 172233 | 1/1935 | Switzerland | 224/156 |

*Primary Examiner*—Gary L. Smith
*Assistant Examiner*—Michael Milano
*Attorney, Agent, or Firm*—Riches, McKenzie & Herbert

[57] ABSTRACT

A combination cot and backpack having first and second equal sized rigid frame sections which are hinged together at one end and pivot between a closed position to form a backpack and an open position to form an elevated cot. First and second sheets of flexible material are laced tautly between side portions of the first and second frame sections. A third frame section telescopes out from the second frame section to provide additional length for the cot. The third frame section is covered by a third sheet which unfolds from the second sheet and is held tautly by connectors underneath. The frame sections are made of tubular aluminum and have rigid downwardly extending u-shaped cross portions which provide legs for the elevated cot. Removable elongated storage pouches fit between the hinged frame sections in the closed position. A detachable carrying harness extends from a closure strap with a buckle which extends around the pack to hold it in the closed position.

24 Claims, 10 Drawing Sheets

COMBINATION BACKPACK AND COT

BACKGROUND OF THE INVENTION

This invention relates to a combination cot and backpack having two rigid frame sections which are hinged together to pivot between an open cot position and a closed backpack position.

Combination foldable cot and backpack structures are well known in the art. U.S. Pat. No. 3,848,279 to Ipsen, Jr. which issued Nov. 19, 1974 shows an arrangement having two portions connected by a connecting device. U.S. Pat. No. 3,601,825 to Moorhead which issued Aug. 31, 1971 similarly discloses a foldable cot having a pair of frame sections interconnected by a third frame section. U.S. Pat. No. 3,619,827 to Mackenzie which issued Nov. 16, 1971 also shows a foldable cot with pivotal sections connected by an arm. In each case, these prior arrangements have pivoted legs so the erected cot is not as stable as is desirable and there is no provision of an enclosure in the closed position.

U.S. Pat. No. 3,971,495 to Velazquez which issued July 27, 1976 shows a combination tent, cot and backpack having a telescopic frame on which the legs are rigid to overcome this problem. However, in the backpack mode, the legs project in an awkward and cumbersome manner.

SUMMARY OF THE INVENTION

Accordingly, it is an object of the present invention to at least partially overcome the disadvantages of the prior art by providing a combination cot and backpack having two rigid frame sections which are hinged together to pivot between an open position to provide an elevated cot and a closed position to form an enclosed backpack.

To this end, in one of its aspects, the invention provides a combination cot and backpack structure having an open position to form an elevated cot and a closed position to form a backpack comprising; first and second rigid frame sections, each of which has first and second ends and a pair of parallel spaced side portions interconnected at the first and second ends respectively by first and second u-shaped cross portions which extend a predetermined distance downwardly in the open position, first and second sheets of flexible material mounted respectively on each of the first and second frame sections to extend tautly across between the side portions, connecting means to interconnect the first and second frame sections in both the open position in which the first end of the first frame section abuts the first end of the second frame section with the side portions of the first and second frame sections substantially aligned, and in the closed position in which the side portions of the first and second frame sections abut to form a backpack enclosure between the first and second frame sections, and carrying harness attached to the structure in the closed position.

Further objects and advantages of the invention will appear from the following description taken together with the accompanying drawings.

DETAILED DESCRIPTION OF THE DRAWINGS

Figure 1:
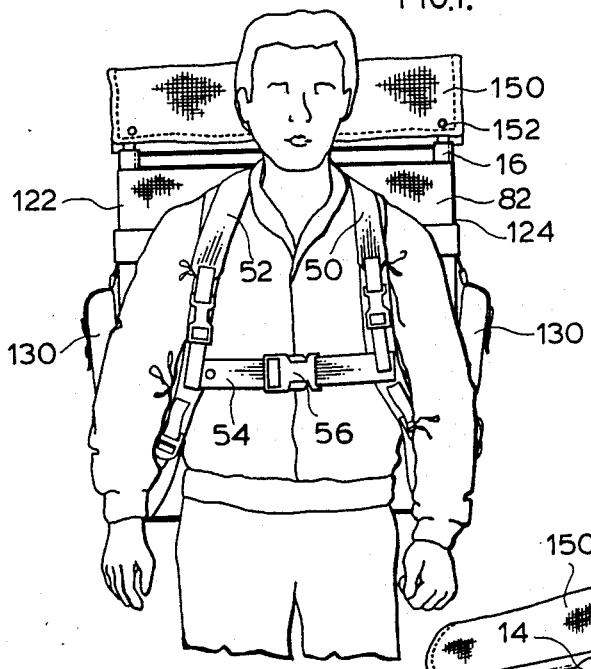
FIG. 1 is an isometric view showing the use of a backpack according to a preferred embodiment of the invention.
Figure 2:
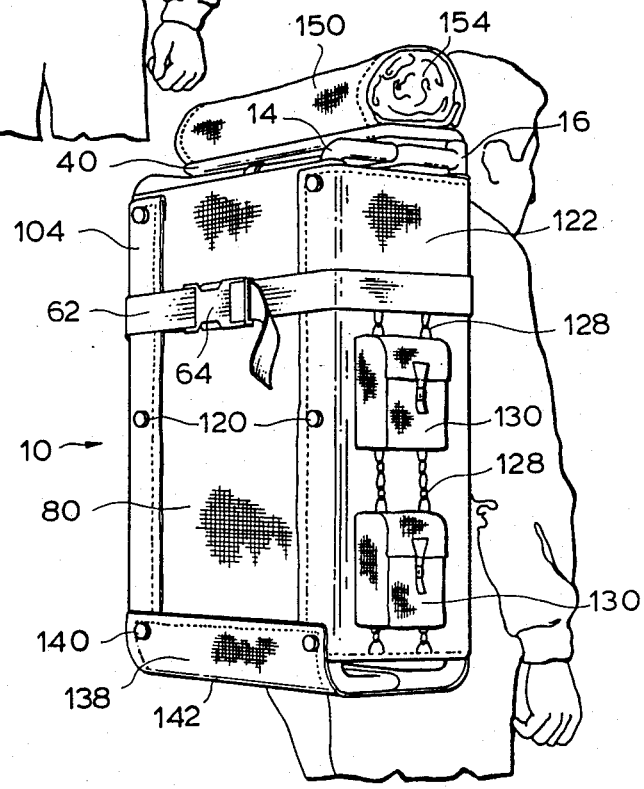
FIG. 2 is another similar view of the same backpack.
Figure 3:
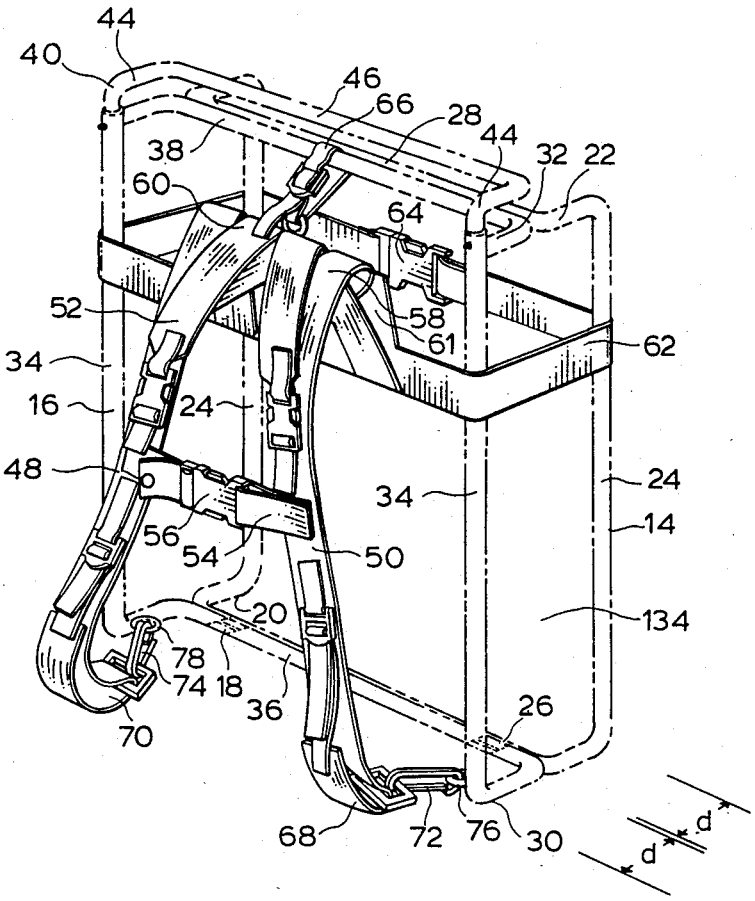
FIG. 3 is an isometric view of the same backpack without the sheets of flexible material to show the arrangement of the frame sections and the carrying harness.

This invention relates to a combination cot and backpack structure which converts between a closed position where it forms a backpack 10 and an open position where it forms a cot 12. Reference is first made to FIGS. 1—3 which show the backpack 10 formed when the structure is in the closed position. As can best be seen in FIG. 3, the structure has a first rigid tubular frame section 14 connected to a second rigid tubular frame section 16 by recessed hinges 18. The first rigid frame section 14 has a first end 20 and a second end 22 with a pair of parallel spaced side portions 24 interconnected at the first end 20 by a first u-shaped cross portion 26 and at the second end 22 by a second u-shaped cross portion 28. The first and second u-shaped cross portions 26,28 extend a selected distance "d" inwardly in the closed position shown in FIG. 3 or downwardly in the open position shown in FIG. 7. Thus, this dimension "d" determines the thickness of the backpack 10 in the closed position and the height of the cot 12 in the open position. The second rigid frame section 16 also has a first end 30 and a second end 32 with a pair of parallel spaced side portions 34 interconnected at the first end 30 by a first u-shaped cross portion 36 and at the second end 32 by a second u-shaped cross portion 38. The second frame section 16 is the same size as the first frame section 14, and the first and second u-shaped cross portions 36,38 extend inwardly or downwardly the same distance "d". Thus, when the first and second frame sections 14,16 pivot together to the closed position on the hinges 18 which connect the first u-shaped cross portion 26 of the first frame section 14 to the first u-shaped cross portion of the second frame section 16, the second u-shaped cross portion 28 of the first frame section 14 abuts against the second u-shaped cross portion 38 of the second frame section 16. The second frame section 16 has a third rigid frame section 40 which extends telescopically from its second end 32 as described below. The third frame section 40 has a pair of parallel spaced side portions 42 which are similarly interconnected at their remote ends 44 by a u-shaped cross portion 46 which also extends inwardly or downwardly the same distance "d". The rigid frame sections 14,16 and 40 are formed of tubular aluminum in this preferred embodiment, but may also be made of other suitable strong lightweight material.

In the embodiment shown, the backpack 10 has a detachable carrying harness 48 with a pair of adjustable shoulder straps 50,52 and a chest strap 54 having a releasable buckle 56. The top ends 58,60 of the shoulder straps 50,52 connect to a yoke extension 61 from a closure strap 62 which in turn extends around the first and second frame sections 14 and 16 and holds them securely together in the closed position. The closure strap 62 also has a releasable buckle 64 which is undone to open the pack 10 normally after the pack 10 has been lowered from the back of the packer. The yoke extension 61 of the closure strap 62 is attached by an adjustable stabilizing strap 66 to the middle of the second u-shaped cross portion 38 of its second frame section 16. This stabilizing strap 66 prevents the pack from pulling away from the packers shoulders thus destabilizing the load and can be adjusted to a comfortable position. The bottom ends 68,70 of the shoulder straps 50,52 are connected by snaps 72,74 to rings 76,78 on the first end 30 of the second frame section 16. Thus, when the pack 10 is opened by undoing the closure strap buckle 64, the carrying harness 48 can be detached completely by undoing the snaps 72,74 and the stabilizing strap 66. While the closure strap 60 is shown in this embodiment, it is apparent that a clasp or some other arrangement can be provided to releasably retain the first and second frame sections 14,16 together in the closed position.

Figure 4:
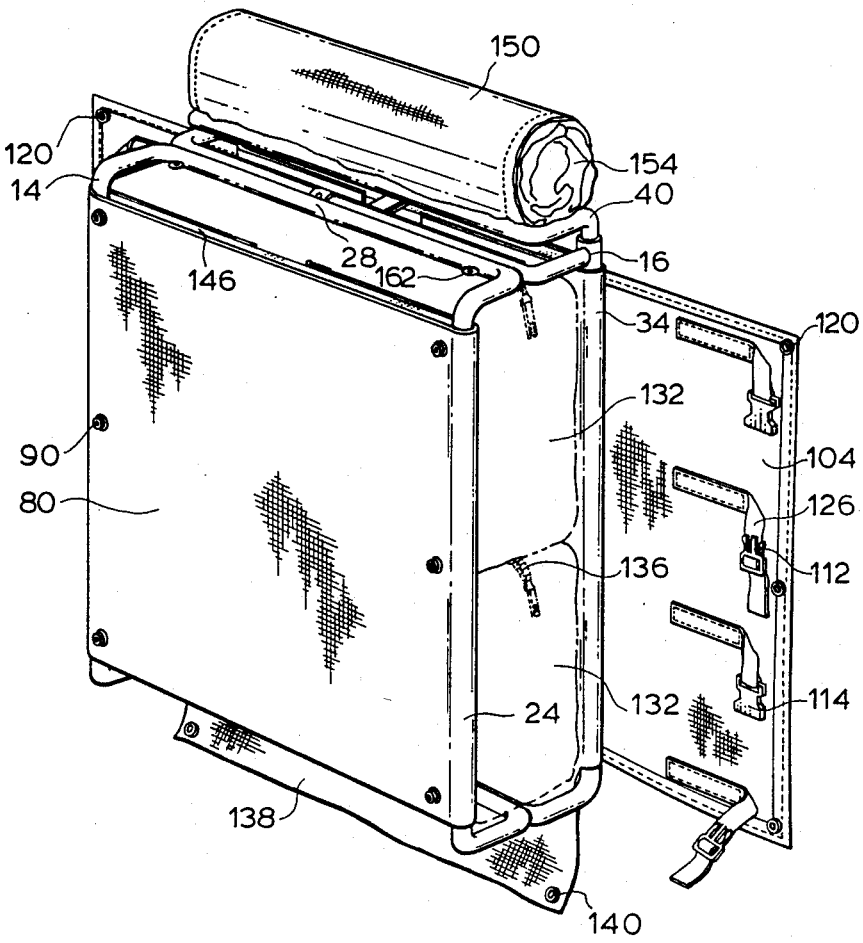
FIG. 4 is an isometric view of the same backpack showing the side flaps undone.
Figure 5:
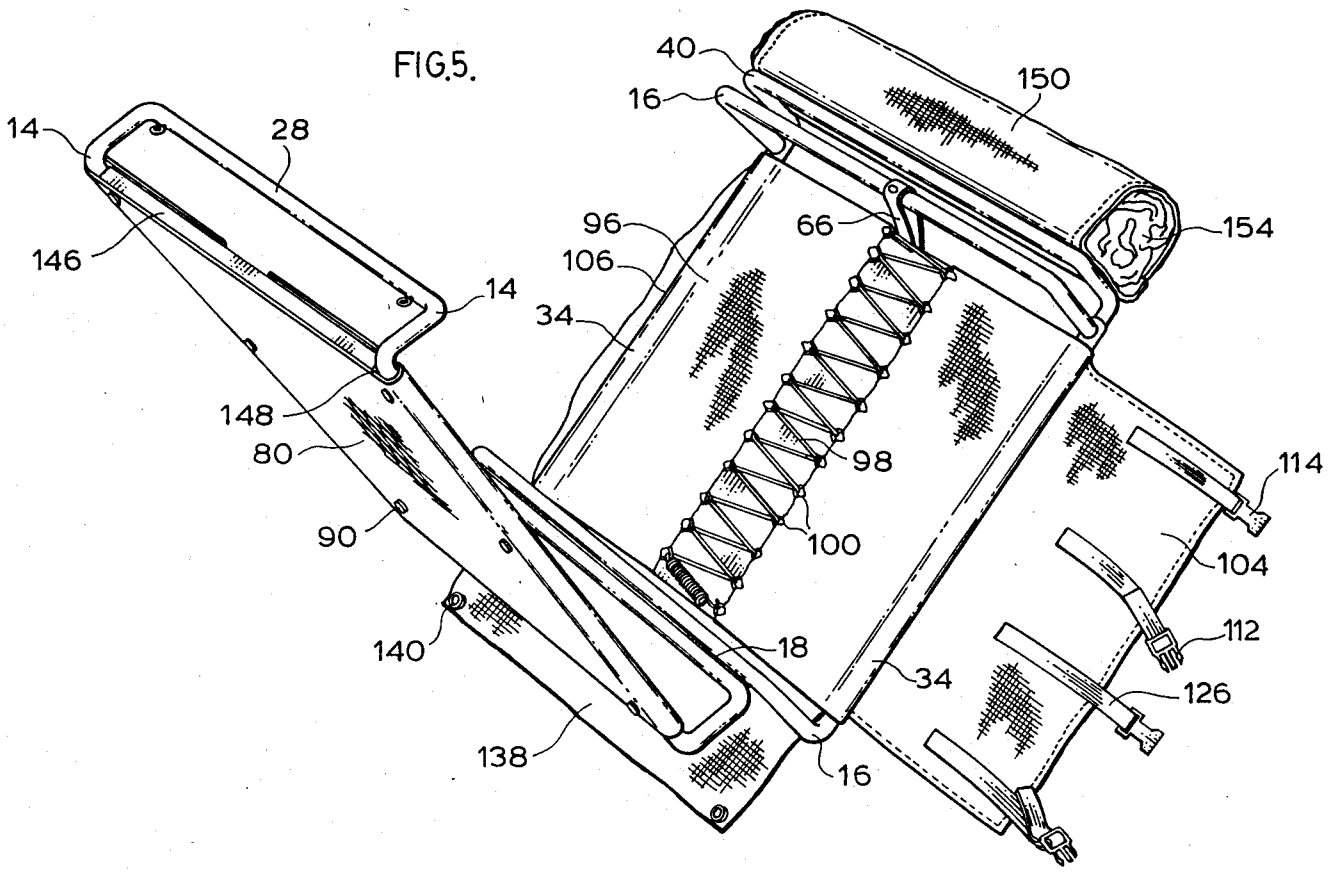
FIG. 5 is an isometric view of the same backpack which has been partially opened and the pouches removed.
Figure 6:
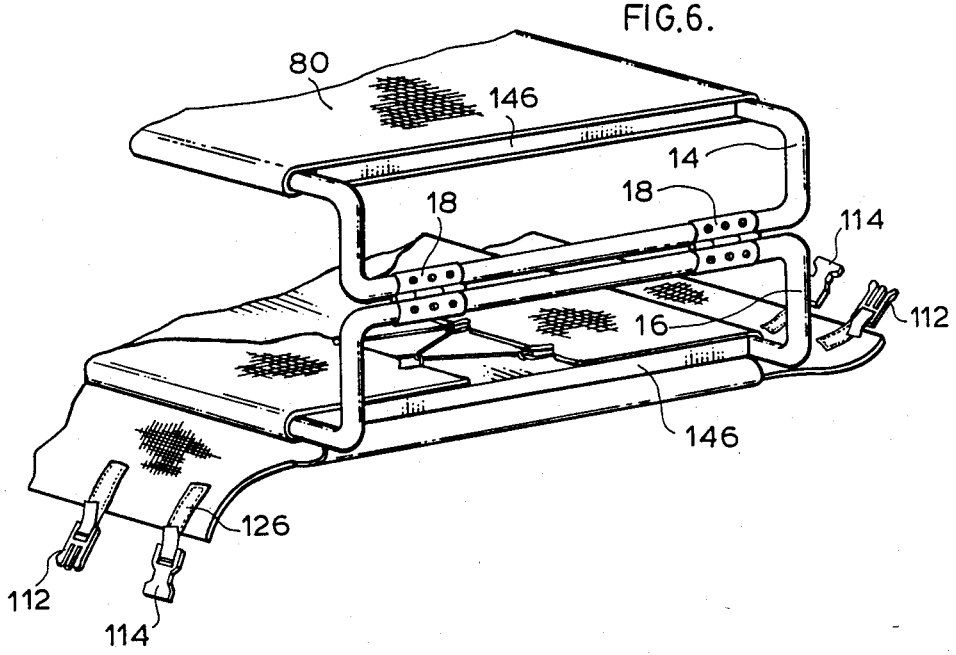
FIG. 6 is a partial isometric view showing the hinges connecting the frame sections together.
Figure 7:
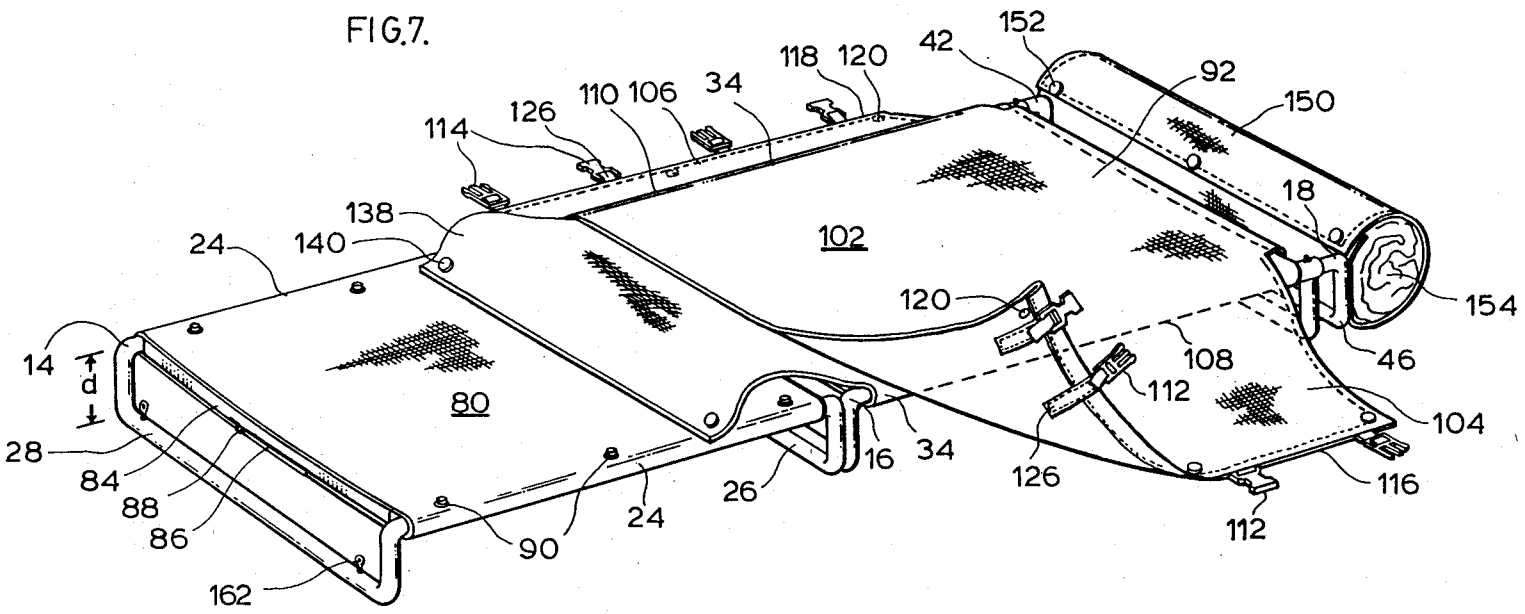
FIG. 7 is an isometric view of the same backpack which has been fully opened to convert it into a cot.
Figures 8, 9:
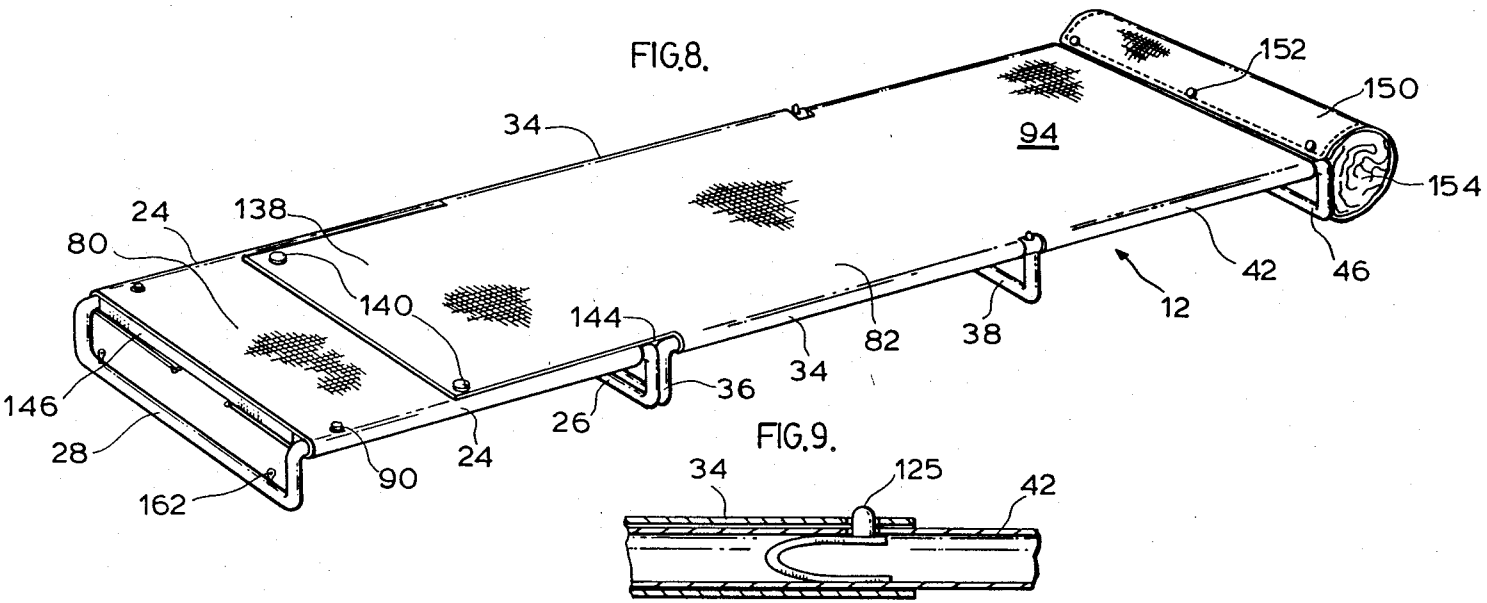
FIG. 8 is an isometric view of the same cot showing the third frame section and the third sheet of flexible material in the extended position.
FIG. 9 is a sectional view showing one of the push button locks.

As best seen in FIGS. 5, 7 and 8, the first and second frame sections 14,16 are each covered with a sheet of flexible material 80,82 which extends tautly between the side portions 24,34 and faces outwardly in the closed position. In this embodiment of the invention, the first sheet 80 of flexible material on the first frame section 14 is formed by a rectangular piece of flexible material 84 which is wrapped around the two parallel spaced side portions 24 of the frame section 14 and held securely in place by lacing 86 extending through eyelets 88. Dome fasteners 90 are fixed to the material to extend in selected locations along the sides of the sheet 80 as described below. The second sheet 82 of flexible material is formed by a specially shaped larger piece 92 of flexible material which also provides a third sheet 94 of flexible material which extends tautly across between the side portions 42 of the third frame section 40 in the extended position. As seen in FIG. 5, one part 96 of this piece 92 of material is wrapped around the two parallel spaced side portions 34 of the second frame section 16 and held securely in place by lacing 98 extending through eyelets 100. Another part 102 of this piece 92 of material folds back upon the second sheet 82 in the closed position and has flaps 104,106 extending along each side 108,110. As seen in FIG. 7, the flaps 104,106 nave matching connectors 112,114 along their outer edges 116,118, as well as dome fasteners 120 to match the dome fasteners 90 on the first sheet 80 of flexible material. As seen in FIGS. 2 and 4, these flaps 104,106 each fold around one side portion 34,24 of each of the first and second frame sections 14,16 to enclose the sides 122,124 of the pack 10, and are retained in this position by dome fasteners 90,120. After the first and second frame sections 14,16 are pivoted to the open position, the telescopic third frame section 40 is extended from the second frame section 16 to the position shown in FIG. 8. As shown in FIG. 9, it is held securely in this position by springloaded pushbuttons 125 which extend through holes 127 in the side portions 34 of the second frame section 16. Then the other part 102 of the piece 92 of flexible material is unfolded over the extended third frame section 40. The side flaps 104,106 are folded underneath the spaced parallel side portions 42 of the third frame section 40, and the connectors 112 are snapped together. The straps 126 leading to the connectors 112,114 are adjustable in length so the third sheet 94 of flexible material which is continuous from the second sheet 82 is secured to extend tautly between the side portions 42 of the third frame section 40 when it is in the extended position.

As best seen in FIG. 2, the side flaps 104,106 have rings 128 connected thereto to removably receive carrying pockets 130 which are on the sides 122,124 of the pack 10 in the close position. While these pockets 130 can be made to be an integral part of the pack, it is preferable that they be removable as otherwise they are located underneath the cot 12 in the open position. At any rate, detachable carry pockets have been found to be very convenient for occasional use separately from the backpack 10. The pack also has elongated storage pouches 132 which fit in the enclosure 134 between the first and second frame sections 14,16 in the closed position. These pouches 132 are formed of a flexible material with a zipper or VELCRO (trade mark of Velcro Industries B.V. for a touch fastener) opening 136, and are removable when the pack is opened so as to be portable to different locations around the camp. While two pouches 132 are shown in this embodiment, it may be desirable to have a different number with dimensions to fill the enclosure 134 between the first and second frame sections 14,16.

In the embodiment shown, the piece 92 of flexible material which forms the second and third sheets 82,94 also has a fourth sheet 138 extending from it. In the closed position seen in FIG. 2, this fourth sheet 138 extends beneath the first and second frame sections 14,16 and is held in place by dome fasteners 140 to provide a bottom 142 for the pack 10. In the open position shown in FIG. 8, the fourth sheet 138 extends to bridge the gap 144 between the first and second sheets 80,82. The dome fasteners 140 connect to different ones of the dome fasteners 90 on the first sheet 80 which are located to hold the fourth sheet 138 tautly in place. In the preferred embodiment, the first, second, third and fourth sheets 80,82,94,138 and the pockets and pouches 130,132 are all made of light weight nylon. However, it will be appreciated that they can be made of other suitable strong flexible material. In order to provide additional warmth on the elevated cot 12, thin flexible sheets 146 of closed cell insulating foam are inserted into the thin openings 148 formed between the first and second nylon sheets 80,82 and the lacing 86,98 which holds them in place.

Figure 10:
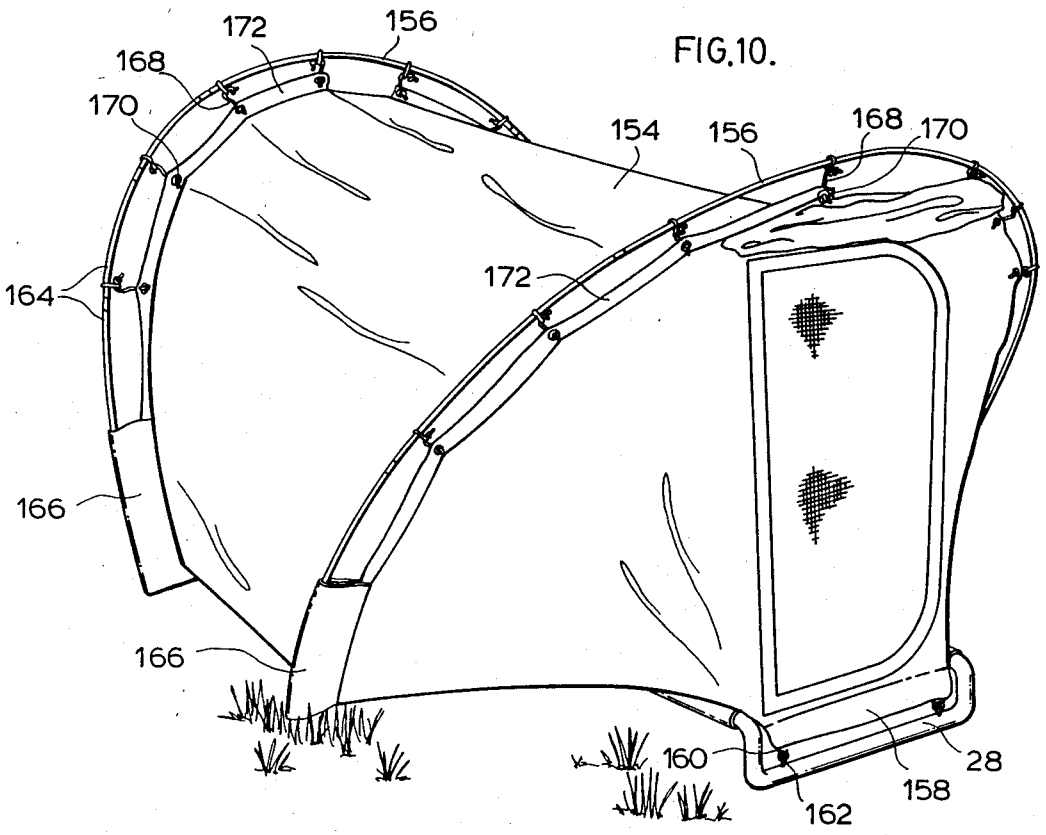
FIG. 10 is an isometric view showing the tent erected on the cot.

The u-shaped cross portion 46 of the third frame section 40 which is at the top of the pack 10 in the retracted position has a flexible tent jacket 150 fastened to it by screws (not shown). The jacket 150 is closed by dome fasteners 152 to hold a tent 154 and collapsible tent rods 156 which are rolled up inside in the closed position. The tent floor (not shown) is fixed to the jacket 150 (and thus indirectly to the third frame section 40) at one end and has a flap 158 projecting at the other end which is secured by hooks 160 to eyelets 162 extending from the second u-shaped cross portion 28 of the first frame section 14 when the tent is erected. The tent rods 156 each have a number of interconnecting hollow sections 164 with a flexible cord (not shown) extending therethrough for ease of assembly. When the rods 156 are assembled they are flexibly resilient and are mounted with their ends in pockets 166 on opposite sides of the tent 154 as shown in FIG. 10. The tent 154 is supported from the rods 156 in a conventional manner by hooks 168 which slide on each rod 156 and are inserted through eyelets 170 spaced along a fringe 172 extending over each end of the tent 154. The tent 154 is also made of lightweight nylon which is waterproof and can be rolled up into a small space in the jacket 150. The tent 154 can have various different shapes and features and can be made of other suitable materials.

In use, the packer's provisions are loaded in the pockets 130 and the pouches 132, and the tent 154 is rolled in the jacket 150. The pouches 132 are loaded inside the pack 10 before it is closed and the pockets 130 are mounted on the sides 122,124 of the pack. The carrying harness 48 is adjusted to comfortably fit the packer, who carries the loaded pack as shown in FIGS. 1 and 2. After a camping destination has been reached, the pack 10 is lowered to the ground and opened by undoing the buckle 64 on the closure strap 62 and the dome fasteners 120,140. After the harness 48 and pockets 130 have been detached and the storage pouches 132 removed, the first and second frame sections 14,16 are pivoted around hinges 18 to the fully open position shown in FIG. 7. The third frame section 40 with the jacket 150 and the tent 154 attached to it is pulled out to the position shown in FIG. 8. The third sheet 94 is then unfolded over the third frame section 40 with the side flaps 104,106 folded beneath the side portions 42, and the connectors 112,114 are done up to hold them in place. The fourth sheet 138 is then snapped into place to bridge the gap 144 between the first and second sheets 80,82 to form the cot 12 seen in FIG. 8. If the first, second and third sheets 80,82 and 94 are not sufficiently taut between the side portions of the respective frame section, the lacing 86,98 and/or connector straps 126 are tightened to the necessary extent. After the cot is suitably located on the ground, the tent jacket 150 is undone and the tent is then unrolled along the cot 12 where it is held in place by attaching the hooks 160 to the eyelets 162 on the cross portion 28. The tent 154 is then easily erected by assembling the rods 154, mounting them in a flexed position by locating their ends in pockets 166 and stringing the hooks 168 through eyelets 170 on the tent fringes 172. Erection of the cot and tent only takes a few minutes and provides comfortable enclosed elevated sleeping accommodation on even relatively rough terrain. The rigid structure of the frame sections ensure that the elevated cot 12 is solid and there is no danger of the legs collapsing which is a very considerable improvement over most previous collapsible cots.

In the morning, the tent 154 is taken down and rolled up with the rods 156 in the tent jacket 150. Dome fasteners 140 and connectors 112,114 are undone, and the third sheet 94 is folded back over the second sheet 82. After the third frame section 40 is retracted and the storage pouches 132 loaded in position, the first and second frame sections 14,16 are folded back to the closed position to form the backpack 10. The buckle 64 on the closure strap 62 is reconnected to hold them in place, and the flaps 104,106 are snapped into position to form the sides 108,110 of the pack. If the harness 48 was completely detached, it is reattached by doing up snaps 72,74 and the stabilizing strap 66. The fourth sheet 138 is then snapped into position to form the bottom 142 of the pack 10.

Figure 11:
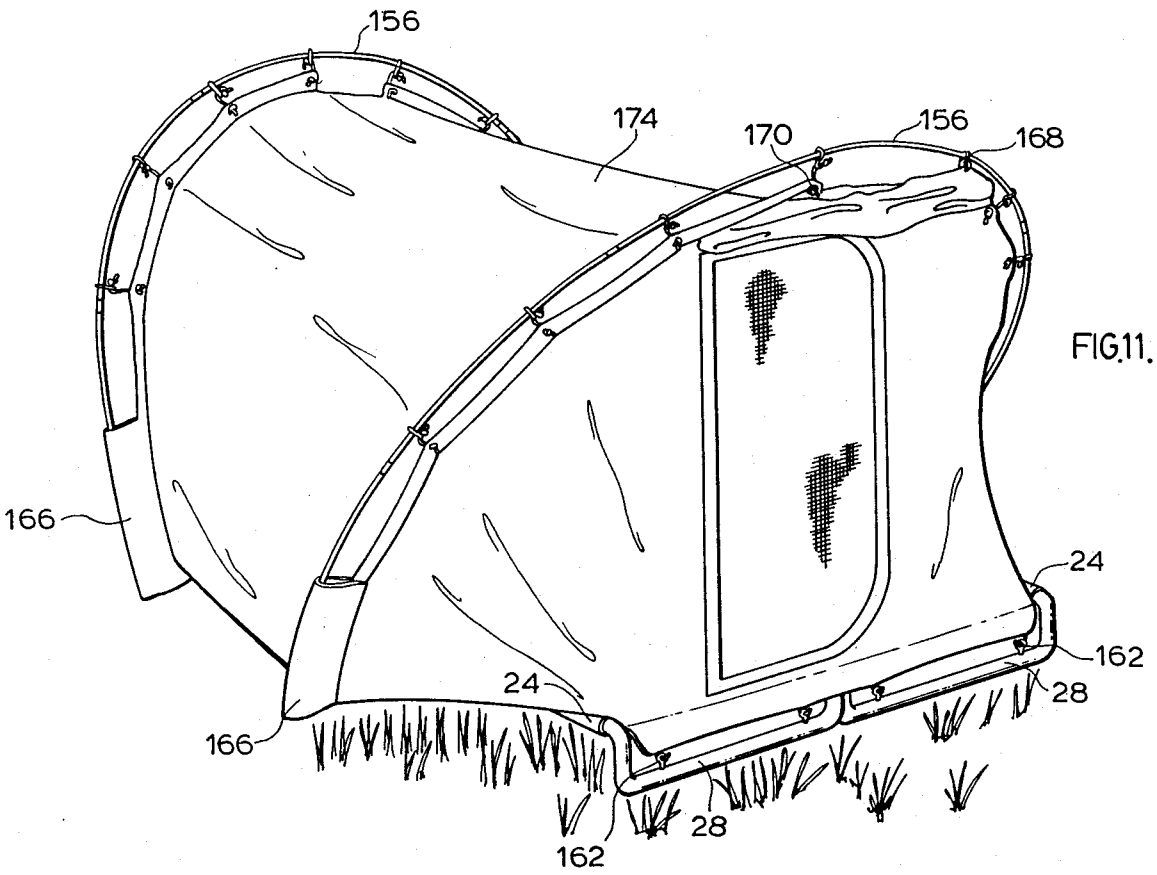
FIG. 11 is an isometric view showing another embodiment of the invention having a two person tent erected on a pair of cots which are connected together in a side-by-side relationship.

FIG. 11 illustrates an alternate embodiment of the invention for two people who want to share a single tent. In this case, each person has a pack the same as that described above except that one pack has a larger two person tent 174 and the other pack has none. Erection of the tent 174 is the same as that described above except that after the two cots 12 are set up they are connected together by hooks or tethers (not shown) in a side-by-side arrangement. The tent 174 is then unfolded over both cots 12 and secured in place by hooks 168. As shown, the erected tent 174 covers both cots to provide comfortable accommodation for both packers.

Figure 12:
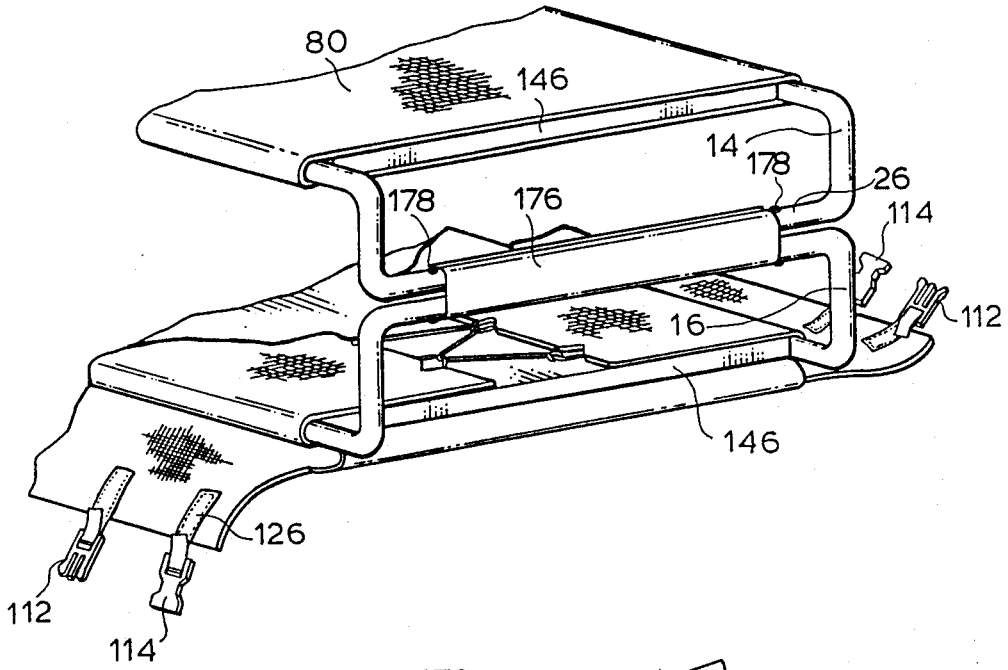
FIG. 12 is a partial isometric view showing the frame sections clamped together according to another embodiment of the invention.
Figure 13:
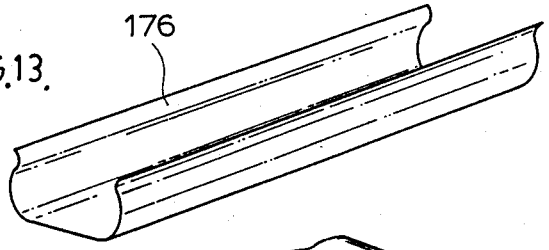
FIG. 13 is an isometric view of the clamp seen in FIG. 12.
Figure 14:
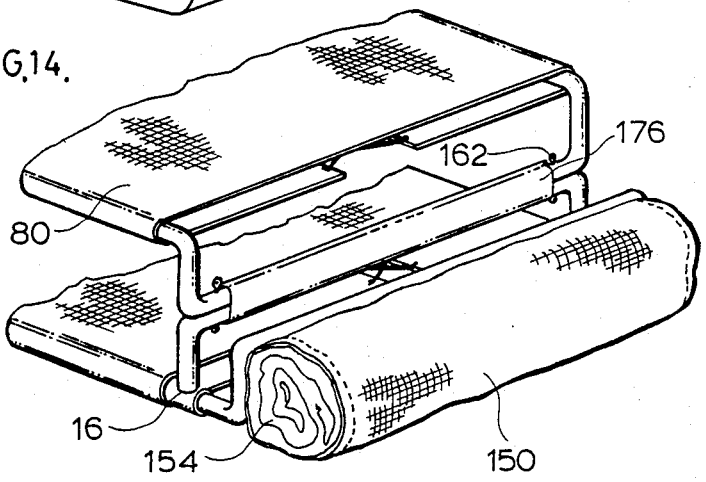

FIGS. 12 and 13 illustrate another embodiment of the invention in which the first cross portion 26 of the first frame section 14 is connected to the first cross portion 36 of the second frame section 18 by an elongated clamp 176 having a u-shaped cross-section. The resilient clamp is made of spring steel and is held in position between stops 178. This clamp 176 is removable which has the advantage that the first and second frame sections 14,16 can be separated in camp to provide separate seats. Of course, many other suitable means can be used to connect the first and second frame sections 14,16 together in both the open and closed positions. As seen in FIG. 14 similar releasable clamping or connecting means 176 can be used to connect the second cross portion 28 of the first frame section 14 to the second cross portion 38 of the second frame section 16 in the closed position if the closure strap 62 with the buckle 64 is not used and the carrying harness 48 is connected directly to the frame sections. In yet another embodiment (not shown), a pair of single clamps similar to clamps 176 can be hinged together to provide a combined hinge/clamp connection.

While this description of the combination cot and backpack has been given with respect to preferred embodiments, it is not to be construed in a limiting sense. Variations and modifications will occur to those skilled in the art. For instance, rather than providing the taut first and second support sheets 80,82 by lacing the material underneath, continuous sleeves of material which slip over the respective frame sections can be used provided the material does not stretch unacceptably. Various other ways of attaching the sheets to the frame sections can also be used. A rain sheet to protect the pack when being transported in a canoe can also be provided. Reference is made to the appended claims for a definition of the invention.

What I claim is:

1. A combination cot and backpack structure having an open position to form an elevated cot and a closed position to form a backpack comprising:

(a) first and second rigid frame sections, each of which has first and second ends and a pair of parallel spaced side portions interconnected at the first and second ends respectively by first and second u-shaped cross portions which extend rigidly a predetermined distance downwardly in the open position, (b) first and second sheets of flexible material mounted respectively on each of the first and second frame sections to extend tautly across between the side portions, (c) connecting means to interconnect the first and second frame sections in both the open position in which the first end of the first frame section abuts the first end of the second frame section with the side portions of the first and second frame sections substantially aligned, and in the closed position in which the u-shaped cross portions extend inwardly to form a back pack enclosure between the first and second frame sections, and (d) carrying harness attached to the structure in the closed position.

2. A structure as claimed in claim 1 wherein the connection means comprise hinge means pivotally connecting the first cross portion of the first frame section to the first cross portion of the second frame section whereby the first and second frame sections are pivotable between the open and closed positions.

3. A structure as claimed in claim 2 including releasable closure means to retain the first and second frame sections together in the closed position.

4. A structure as claimed in claim 1 wherein the carrying harness extends from a closure strap with a releasable buckle which extends around the pack to hold the first and second frame sections together in the closed position.

5. A structure as claimed in claim 4 further including an adjustable stabilizing strap which extends from the closure strap adjacent the carrying harness to the second cross portion of the second frame section.

6. A structure as claimed in claim 1 further including a third rigid frame section having a pair of parallel spaced side portions which extend telescopically from the second end of the second frame section in the open position and are interconnected at their remote ends by a u-shaped cross portion which extends downwardly said predetermined distance in the open position, and a third sheet of flexible material which foldably extends from the second sheet of flexible material and is mountable to extend tautly across between the side portions of the third frame section in the extended position.

7. A structure as claimed in claim 6 including locking means to releasably lock the third frame section in the extended position.

8. A structure as claimed in claim 6 further including a fourth sheet of flexible material extending between the first and second sheets of flexible material in the open position.

9. A structure as claimed in claim 7, wherein the third sheet of flexible material has flaps extending along opposite sides, each flap having disengageable connectors whereby the flaps extend around and are interconnected beneath the side portions of the third frame in the extended position.

10. A structure as claimed in claim 9 wherein the carrying harness is disconnectable.

11. A structure as claimed in claim 9 further including a plurality of elongated removable storage pouches shaped to be received crosswise in the enclosure formed between the frame sections in the closed position.

12. A structure as claimed in claim 9 wherein the carrying harness includes a closure strap with a releasable buckle to securely retain the first and second frame sections in the closed position.

13. A structure as claimed in claim 9 further including a tent which is detachably secured to the first and third frame sections in the open position, the tent being erectable with a tent floor overlying the sheets of flexible material on the frame sections.

14. A structure as claimed in claim 13 wherein in the closed position the tent rolls into a cover detachably secured to the cross portion of the third frame section.

15. A structure as claimed in claim 9 wherein the frame sections are made of tubular aluminum.

16. A structure as claimed in claim 15 wherein the sheets of flexible material are made of nylon.

17. A structure as claimed in claim 9 wherein the first and second sheets of flexible material are looped around the side portions of the respective frame sections to form thin openings and further including a thin sheet of insulating material removably received in each opening.

18. A structure as claimed in claim 17 wherein the insulating material is a closed cell foam.

19. A structure as claimed in claim 9 further including another identical structure and connecting means for securing the two structures in a side-by-side relationship when both are in the open position.

20. An assembly as claimed in claim 19 further including a two person tent which is detachably secured to the frame sections of both structures, the tent being erectable with a tent floor overlying the sheets of flexible material on the frame sections of both structures.

21. A structure as claimed in claim 1 wherein the connecting means comprise releasable attachment means to attach the first cross portion of the first frame section to the first cross portion of the second frame section in both the open and closed positions.

22. A structure as claimed in claim 21 wherein the connecting means include releasable closure means to retain the first and second frame sections together in the closed position.

23. A structure as claimed in claim 1 further including disengageable flap means extending between the side portions of the frame sections to form opposite sides of the backpack enclosure in the closed position.

24. A structure as claimed in claim 23 wherein in the closed position the first cross portion of the first frame section substantially abuts against the first cross portion of the second frame section, and the second cross portion of the first frame section substantially abuts against the second cross portion of the second frame section.

* * * * *